US009142178B2

(12) United States Patent
Saitoh

(10) Patent No.: US 9,142,178 B2
(45) Date of Patent: Sep. 22, 2015

(54) LIQUID CRYSTAL DISPLAY DEVICE

(75) Inventor: Akihiko Saitoh, Saitama-ken (JP)

(73) Assignee: JAPAN DISPLAY INC., Tokyo (JP)

( * ) Notice: Subject to any disclaimer, the term of this patent is extended or adjusted under 35 U.S.C. 154(b) by 484 days.

(21) Appl. No.: 13/188,550

(22) Filed: Jul. 22, 2011

(65) Prior Publication Data

US 2012/0026420 A1 Feb. 2, 2012

(30) Foreign Application Priority Data

Jul. 30, 2010 (JP) ..... 2010-171961

(51) Int. Cl.
*G09G 3/36* (2006.01)

(52) U.S. Cl.
CPC ..... *G09G 3/3677* (2013.01); *G09G 3/3614* (2013.01); *G09G 3/3655* (2013.01); *G09G 3/3674* (2013.01); *G09G 2300/0876* (2013.01); *G09G 2310/0264* (2013.01)

(58) Field of Classification Search
CPC ..... G09G 2310/0221; G09G 2310/0283; G09G 3/3614; G09G 3/3655; G09G 3/3674; G09G 3/3677; G09G 2310/0264; G09G 2300/0876
USPC ..... 345/98–100
See application file for complete search history.

(56) References Cited

U.S. PATENT DOCUMENTS

| | | | | |
|---|---|---|---|---|
| 6,414,668 | B1 | 7/2002 | Karube et al. | |
| 7,742,015 | B2 | 6/2010 | Tada et al. | |
| 2002/0084969 | A1 * | 7/2002 | Ozawa | 345/96 |
| 2006/0050043 | A1 * | 3/2006 | Kawagoe | 345/98 |
| 2006/0208995 | A1 | 9/2006 | Saitoh et al. | |
| 2007/0195049 | A1 * | 8/2007 | Choi et al. | 345/98 |
| 2008/0012809 | A1 * | 1/2008 | Kim et al. | 345/87 |

(Continued)

FOREIGN PATENT DOCUMENTS

| | | | |
|---|---|---|---|
| JP | 11-202295 | A | 7/1999 |
| JP | 2003-150128 | A | 5/2003 |

(Continued)

OTHER PUBLICATIONS

Japanese Office Action Issued May 22, 2012 in Patent Application No. 2010-171961 (English translation only).
Japanese Office Action issued Aug. 21, 2012 in Patent Application No. 2010-171961 submitting English Translation only.

*Primary Examiner* — Gerald Johnson
*Assistant Examiner* — Christopher Kohlman
(74) *Attorney, Agent, or Firm* — Oblon, McClelland, Maier & Neustadt, L.L.P.

(57) ABSTRACT

In one embodiment, first and second driver circuits are arranged interposing a matrix of pixels. A timing control circuit is electrically connected with the first and second driver circuits. The first driver circuit including a first sequential circuit is electrically connected with the odd scanning lines, and supplies scanning signals to the odd signal lines in order. The second driver circuit including a second sequential circuit is electrically connected with the even scanning lines, and supplies the scanning signals to the even scanning lines in order. The timing control circuit generates first and second synchronization signals, and supplies the first synchronization signal to the first driver circuit and the second synchronization signal to the second driver circuit. The first and second driver circuits supply the scanning signals to the scanning lines in order for every line upon receiving the first synchronization signal and the second synchronization signal from the timing control circuit.

16 Claims, 12 Drawing Sheets

(56) References Cited

U.S. PATENT DOCUMENTS

| | | | | |
|---|---|---|---|---|
| 2008/0055524 | A1* | 3/2008 | Manabe et al. | 349/106 |
| 2008/0079001 | A1* | 4/2008 | Umezaki et al. | 257/59 |
| 2008/0252804 | A1 | 10/2008 | Saitoh et al. | |
| 2009/0174692 | A1* | 7/2009 | Park et al. | 345/204 |
| 2010/0128012 | A1* | 5/2010 | Numao | 345/211 |
| 2010/0201653 | A1 | 8/2010 | Saitoh et al. | |
| 2010/0201666 | A1* | 8/2010 | Tobita | 345/208 |

FOREIGN PATENT DOCUMENTS

| | | | |
|---|---|---|---|
| JP | 2004-226435 | | 8/2004 |
| JP | 2006-171162 | A | 6/2006 |
| JP | 2008-107831 | A | 5/2008 |
| JP | 2008-225424 | | 9/2008 |
| JP | 2009-25428 | A | 2/2009 |
| JP | 2009-69776 | A | 4/2009 |
| JP | 2010-139776 | A | 6/2010 |

* cited by examiner

LIQUID CRYSTAL DISPLAY DEVICE

CROSS-REFERENCE TO RELATED APPLICATION

This application is based upon and claims the benefit of priority from Japanese Patent Application No. P2010-171961, filed Jul. 30, 2010, the entire contents of which are incorporated herein by reference.

FIELD

Embodiments described herein relate generally to a liquid crystal display device.

BACKGROUND

Generally, a liquid crystal display device having such features as a light weight, a thin shape, and low power consumption is used as a display device. The liquid crystal display device is equipped with an array substrate, a counter substrate arranged opposing the array substrate, and a liquid crystal layer held between the array substrate and the counter substrate.

The array substrate includes a glass substrate. On the glass substrate, a plurality of signal lines and scanning lines are arranged crossing each other in a display region. A TFT (Thin Film Transistor) which constitutes a pixel is arranged near an intersection of each signal line and each scanning line. Moreover, a driver circuit connected to the plurality of scanning lines is provided on the glass substrate.

When the TFT is formed using poly-silicon, the driver circuit can be formed simultaneously with the TFT using the poly-silicon. Furthermore, it is not necessary to lay out the scanning lines on a frame region of the glass substrate. Therefore, in the liquid crystal display device with the TFT formed of the poly-silicon, the frame region hardly expands even if the number of pixels of the liquid crystal display device increases.

By the way, the screen size of the liquid crystal display device becomes large for a cell phone unit use, and the number of pixels tends to increase every year. Since an occupancy area of the driver circuit for each scanning line is decided, when the number of pixels increases and a pixel pitch becomes narrow, the lay-out width of the driver circuit with respect to the pixel pitch expands relatively. However, since portability is requested in the cell phone unit, the cell phone unit has a problem that the lateral width of the substrate cannot be increased.

Then, it is thought to arrange the above-mentioned driver circuit by dividing into two or three driver circuits on the both sides of the screen. However, it is necessary to provide mutually different synchronization signals to the respective driver circuits in this case. However, since it is difficult to generate two or three kinds of synchronization signals in the conventional driver circuit, it is necessary to newly develop the driver circuit (integrated circuit) which can generate two or three kinds of synchronization signals, and as a consequence, which causes the raising of a manufacturing cost, and further, the raising of a product price.

BRIEF DESCRIPTION OF THE DRAWINGS

The accompanying drawings, which are incorporated in and constitute a portion of the specification, illustrate embodiments of the invention, and together with the general description supplied above and the detailed description of the embodiments supplied below, serve to explain the principles of the invention.

DETAILED DESCRIPTION OF THE INVENTION

Figure 1:
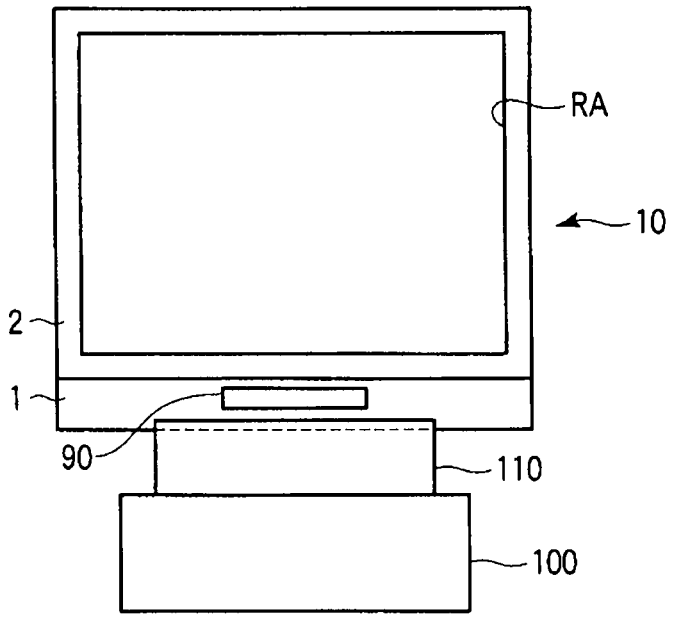
FIG. 1 is a view schematically showing a liquid crystal display device according to a first embodiment.

A liquid crystal display device according to an exemplary embodiment of the present invention will now be described with reference to the accompanying drawings wherein the same or like reference numerals designate the same or corresponding portions throughout the several views.

According to one embodiment, a liquid crystal display device having a plurality of pixels arranged in a matrix of a first direction and a second direction crossing with the second direction includes: an array substrate including; a plurality of signal lines extending in a first direction, a plurality of scanning lines having odd scanning lines and even scanning lines extending in a second direction, a switch element provided in each pixel and electrically connected with the signal line and scanning line, a pixel electrode electrically connected with each switching element, a first driver circuit and a second driver circuit arranged interposing the matrix of pixels in the second direction, and a timing control circuit electrically connected with the first and second driver circuits, a counter substrate arranged opposing the array substrate with a gap therebetween; and a liquid crystal layer held between the array substrate and the counter substrate; wherein the first driver circuit including a first sequential circuit is electrically connected with the odd scanning lines, and supplies scanning signals to the odd scanning lines in order, the second driver circuit including a second sequential circuit is electrically connected with the even scanning lines, and supplies the scanning signals to the even scanning lines in order, the timing control circuit generates a first synchronization signal and a second synchronization signal, and supplies the first synchronization signal to the first driver circuit and the second synchronization signal to the second driver circuit, and the first and second driver circuits supply the scanning signals to the scanning lines in order for every line upon receiving the first synchronization signal and the second synchronization signal from the timing control circuit.

Figure 2:
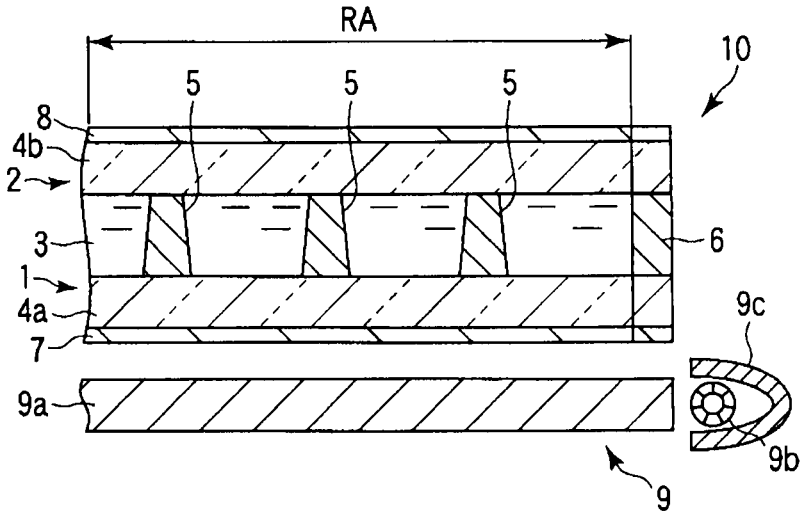
FIG. 2 is a cross-sectional view schematically showing the liquid crystal display device.

Hereafter, the liquid crystal display device according to the first embodiment is explained in detail referring to drawings. As shown in FIG. 1 and FIG. 2, the liquid crystal display device includes a liquid crystal display panel 10. The liquid crystal display panel 10 is constituted by an array substrate 1, a counter substrate 2 arranged opposing the array substrate with a predetermined gap, and a liquid crystal layer 3 held between both substrates. In addition, the liquid crystal display device includes a first optical element 7 arranged on an outside surface of the array substrate 1, a second optical element 8 arranged on an outside surface of the counter substrate 2, a back light unit 9, a signal line driver circuit 90 as an image signal output unit, a control portion 100, and a FPC (flexible Printed Circuit) 110. The liquid crystal display device includes a display region RA in which pixels 18 to be mentioned later are arranged in the shape of a matrix.

Figure 3:
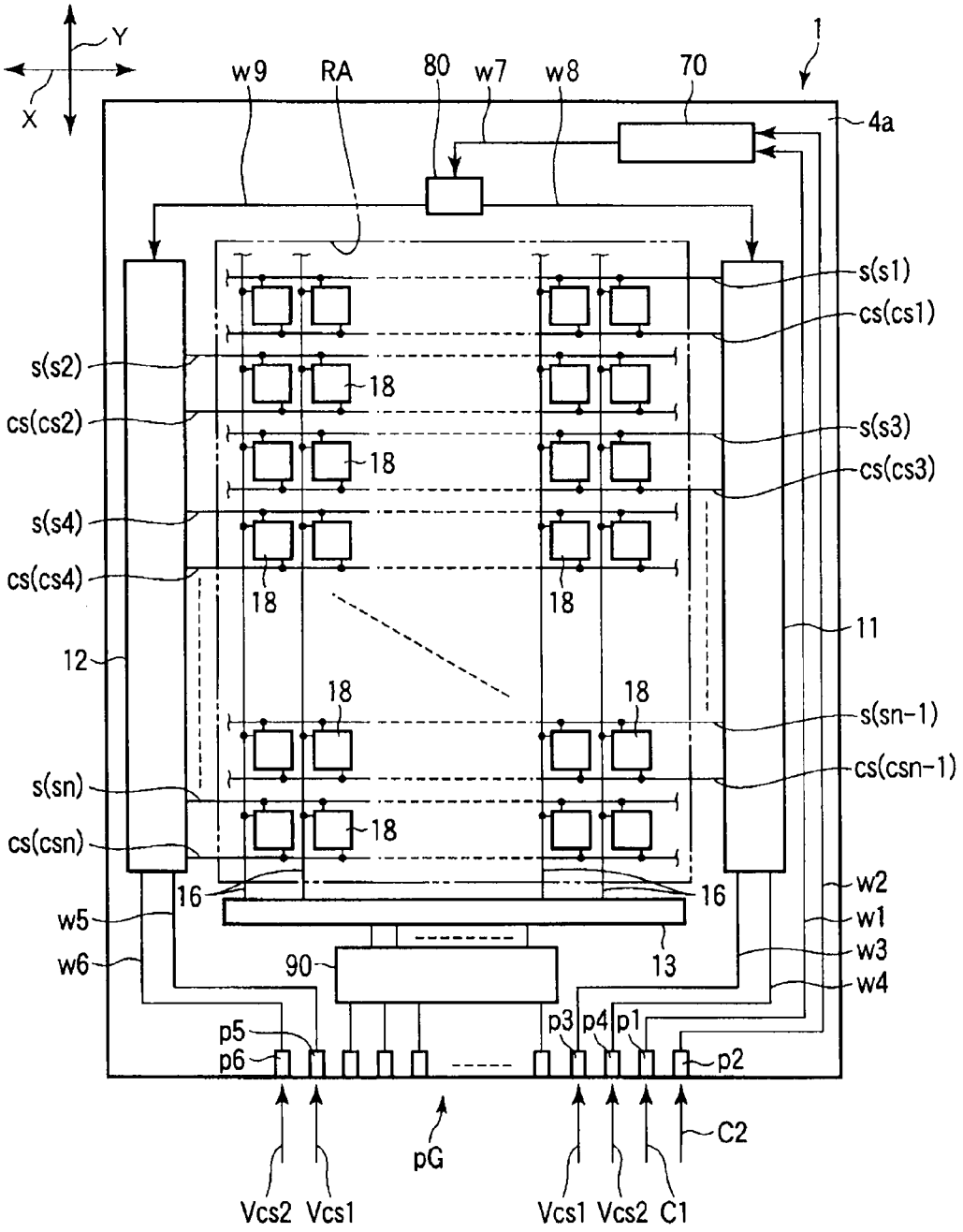
FIG. 3 is a plan view showing a schematic structure of an array substrate shown in FIG. 1 and FIG. 2.

As shown in FIG. 1 to FIG. 3, the array substrate 1 includes a glass substrate 4*a* as a transparent insulating substrate, for example. In the display region RA, the pixels 18 are formed on the glass substrate 4*a*. A first driver circuit 11, a second driver circuit 12, a switch circuit 13, and a plurality of pads (hereinafter, called OLB pads) pG for outer lead bonding are formed on the glass substrate 4*a* in the outside of the display region RA. The first driver circuit 11 and the second driver circuit 12 double as a scanning line driver circuit and an auxiliary capacitance line driver circuit.

In the display region RA, a plurality of scanning lines "s" (s1, s2, -sn) and a plurality of signal lines 16 which intersect perpendicularly with the plurality of scanning lines "s" are arranged on the glass substrate 4*a*. A plurality of auxiliary capacitance lines "cs" (cs1, cs2, -csn) is formed on the glass substrate 4*a* in parallel to the scanning line "s". The signal lines 16 extend in a first direction Y. The scanning lines "s" and the auxiliary capacitance lines "cs" extend in a second direction X which intersects perpendicularly with the first direction Y.

In this embodiment, the pixel 18 is formed in each region surrounded by adjacent signal lines 16 and the adjacent auxiliary capacitance lines "cs". The pixels 18 are arranged in the shape of a matrix.

Figure 4:
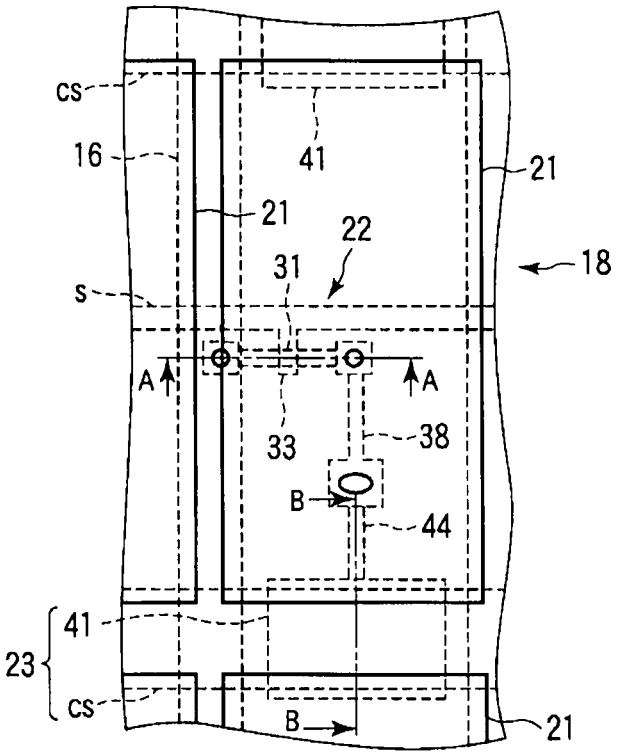
FIG. 4 is an enlarged plan view showing a portion of the array substrate, and is a figure showing a wiring structure of a pixel.
Figure 5:
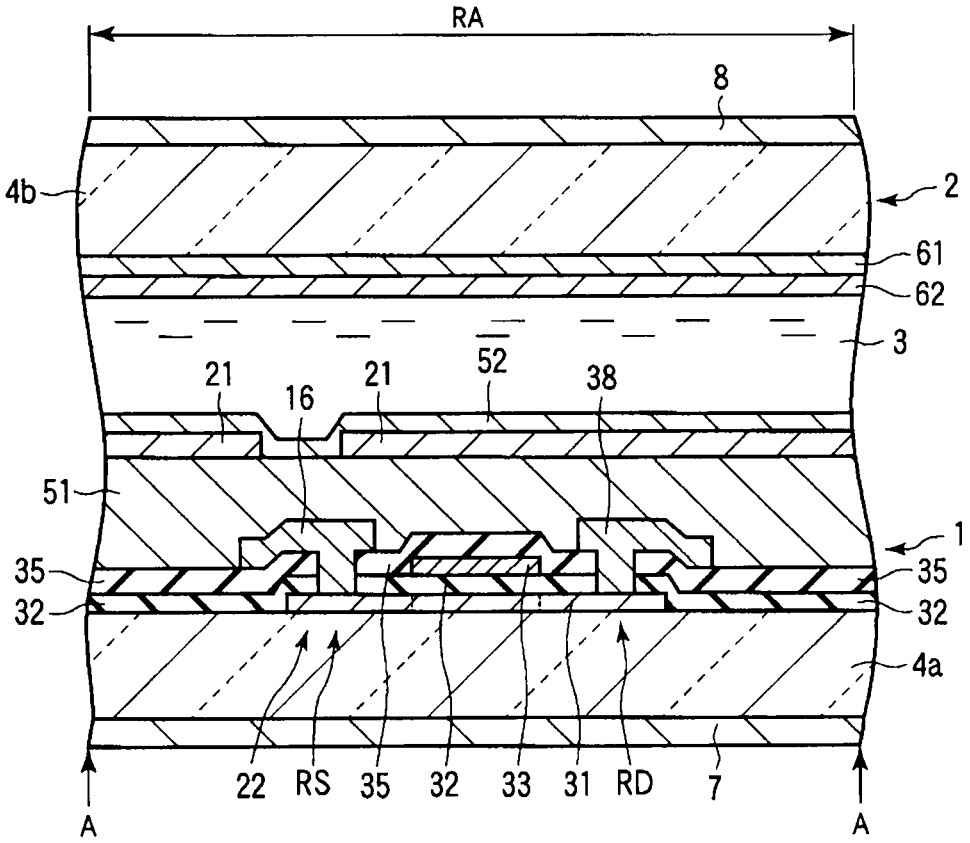
FIG. 5 is a cross-sectional figure taken along line A-A of the liquid crystal display device shown in FIG. 4.

Next, one pixel 18 is picked up and explained in detail. As shown in FIG. 3, FIG. 4, and FIG. 5, the pixel 18 includes a TFT 22 as a switching element electrically connected to the signal line 16 and the scanning line "s", a pixel electrode 21 electrically connected with the TFT 22, and an auxiliary capacitance element 23 connected with the pixel electrode 21.

A semiconductor layer 31 is formed on the glass substrate 4*a*, and a gate insulating film 32 is formed on the glass substrate 4*a* and the semiconductor layer 31. In each region which overlaps with the semiconductor layer 31, a gate electrode 33 which extends from a portion of the scanning line "s" is formed on the gate insulating film 32. An interlayer insulating film 35 is formed on the gate insulating film 32 and the gate electrode 33.

The signal line 16 and a contact wiring 38 are formed on the interlayer insulating film 35, and the signal line 16 and the contact wiring 38 penetrate respective portions of the gate insulating films 32 and the interlayer insulating film 35, and are connected to the semiconductor layer 31, respectively. Here, the signal line 16 is connected with a source region RS of a semiconductor layer 31, and the contact wiring 38 is connected with a drain region RD of the semiconductor layer 31.

Figure 6:
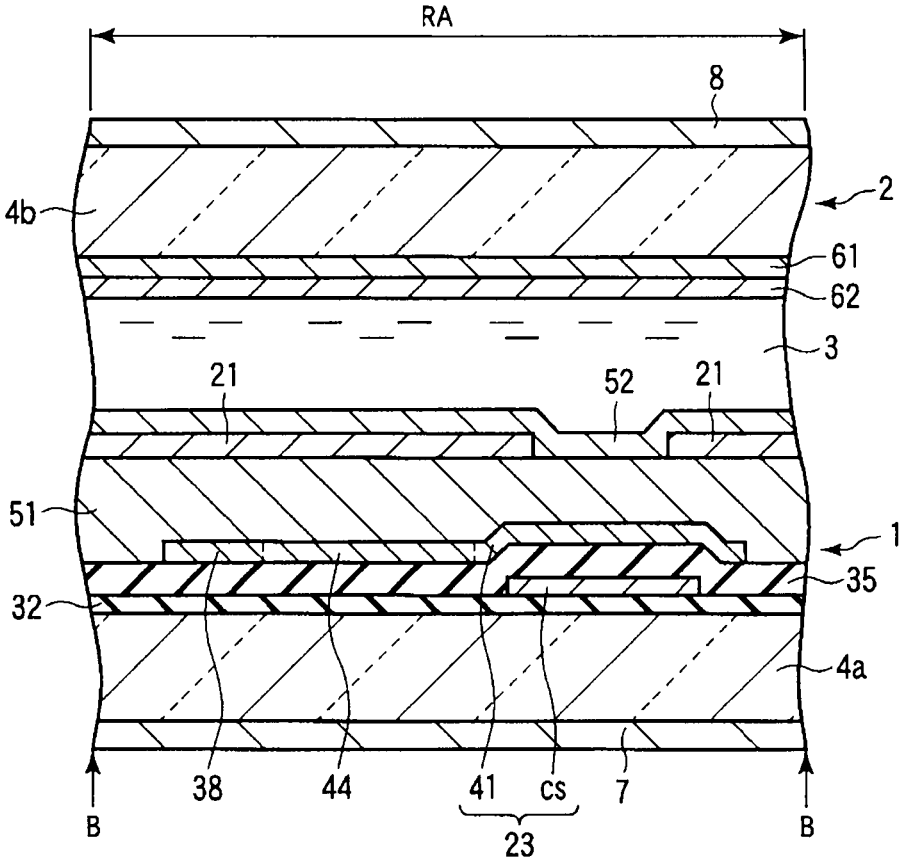
FIG. 6 is a cross-sectional figure taken along line B-B of the liquid crystal display device shown in FIG. 4.

Subsequently, the auxiliary capacitance element 23 is explained. As shown in FIG. 3, FIG. 4, and FIG. 6, the auxiliary capacitance line "cs" and an auxiliary capacitance electrode 41 form an auxiliary capacitance element 23. The auxiliary capacitance line "cs" made of aluminum, for example, as an electric conductive material is formed on the gate insulating film 32 arranged on the glass substrate 4*a*. The interlayer insulating film 35 is formed on the gate insulating film 32 and the auxiliary capacitance line "cs".

In the auxiliary capacitance element 23, the auxiliary capacitance electrode 41 which overlaps with the auxiliary capacitance lines "cs" and a connection wiring 44 connected with the auxiliary capacitance electrode 41 are formed on the interlayer insulating film 35. The connection wiring 44 connects the auxiliary capacitance element 23 with the pixel electrode 21.

The above-mentioned auxiliary capacitance electrode 41, connection wirings 44, contact wirings 38, and signal lines 16 are formed with the same electric conductive material. The auxiliary capacitance electrodes 41, the connection wirings 44, and the contact wirings 38 are integrally formed.

As shown in FIG. 5 and FIG. 6, a plurality of colored layers 51 colored with red, green and blue colors are formed on the glass substrate 4*a* in which the TFT 22 and the auxiliary capacitance element 23 are formed. The plurality of pixel electrodes 21 are formed on the colored layer 51 so as to overlap with the peripheral of the adjacent signal lines 16 and the adjacent auxiliary capacitance lines "cs". A first alignment film 52 is formed on the colored layer 51 and the pixel electrode 21 forming the array substrate 1.

As shown in FIG. 1, FIG. 2, FIG. 5, and FIG. 6, the counter substrate 2 includes a glass substrate 4*b* as a transparent insulating substrate, for example. A counter electrode 61 and an alignment film 62 are formed in order on the glass substrate 4*b*, and constitute the counter substrate 2.

As shown in FIG. 2, the gap between the array substrate 1 and the counter substrate 2 is held by a pillar-shaped spacer 5, for example. The array substrate 1 and the counter substrate 2 are attached by a seal material 6 arranged at the peripheral portions of both substrates.

As shown in FIG. 2, FIG. 5, and FIG. 6, the first optical element 7 is arranged at the external surface of the glass substrate 4*a*. In this embodiment, the first optical element 7 is formed with a polarizing plate. The second optical element 8 is arranged at the external surface of the glass substrate 4*b*. In this embodiment, similarly, the second optical element 8 is formed with a polarizing plate. The external surface of the second optical element 8 is a display surface.

The back light unit 9 is arranged at the external surface side of the first optical element 7. The back light unit 9 includes a light guide plate 9*a* arranged opposing the array substrate 1, and a light source 9*b* and a light reflector 9*c* arranged opposing a side edge of the light guide plate 9*a*. The liquid crystal display device is formed as mentioned-above.

Next, the OLB pads pG, the switch circuit 13, the signal line driver circuit 90, the first driver circuit 11, the second driver circuit 12, a timing control circuit 70, and a buffer 80 are explained. The circuits are arranged in the outside of the display region RA. The pads pG, the switch circuit 13, the first driver circuit 11, the second driver circuit 12, the timing control circuit 70, the buffer 80, etc, can be simultaneously formed with the pixel 18 using the same material. The TFT 22, the first driver circuit 11, the second driver circuit 12, the timing control circuit 70, the buffer 80, and the switch 13 are formed of poly-silicon.

As shown in FIG. 3, the OLB pads pG are formed with a plurality of pads arranged at the periphery of the array substrate 1 (glass substrate 4*a*) in the second direction X. A counter electrode 61 is electrically connected with one of the pad, and a predetermined voltage is impressed to the counter electrode 61 through the pad.

Figure 7:
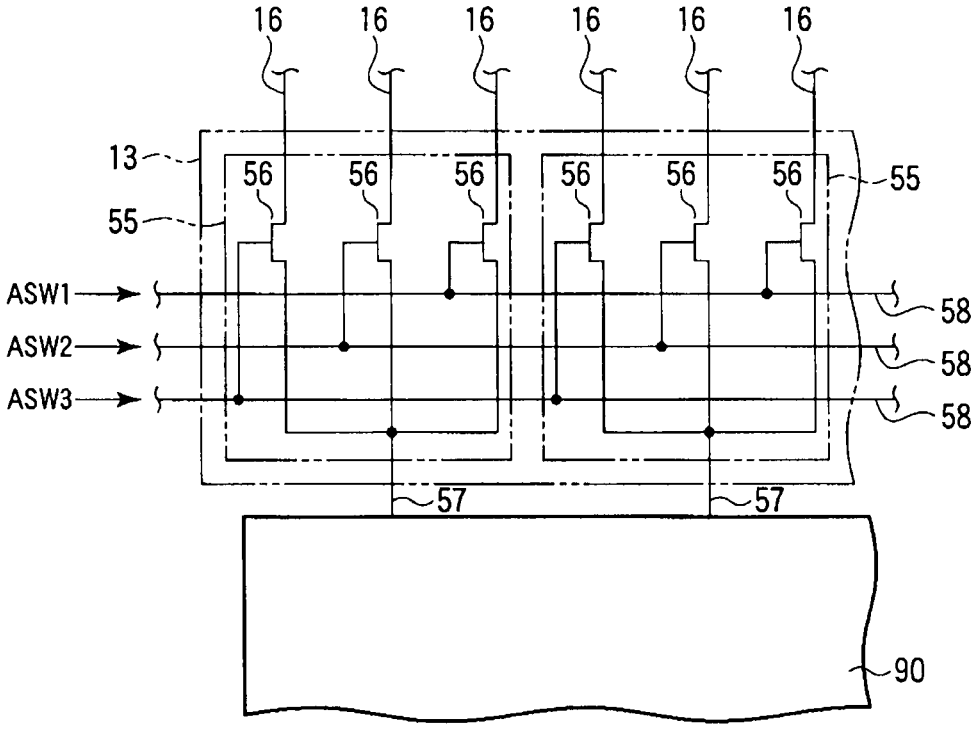
FIG. 7 is an enlarged plan view showing an outside of a display region of the array substrate, and is a figure showing a switching circuit.

As shown in FIG. 1, FIG. 3, and FIG. 7, the switch circuit 13 includes a plurality of switch element groups 55, and each switch element group 55 has a plurality of switch elements 56, respectively. In this embodiment, the switch element group 55 has three switch elements 56, respectively. The switch circuit 13 is a ⅓ multiplexer circuit. The switch element 56 is formed of the TFT, for example, and is formed like the above-mentioned TFT 22 as the switch element 56.

The switch circuit 13 is connected with a plurality of signal lines 16. Moreover, the switch circuit 13 is connected to the signal line driver circuit 90 through connection wirings 57. Here, the number of the connection wirings 57 is ⅓ of the number of the signal lines 16.

Switch elements (analog switch) 56 are switched between an ON state and an OFF state by control signals ASW1, ASW2, and ASW3 so that a time sharing drive of three signal lines 16 per one output (connection wiring 57) of the signal line driver circuit 90 is carried out. The control signals ASW1-ASW3 are supplied from the control portion 100 to the respective switch elements 56 through a plurality of pads which are not illustrated and a plurality of control wirings 58 connected with the pads. The control portion 100 supplies predetermined pixel signals into the pixels 18 arranged in a line in the second direction X by supplying the control signals ASW1-ASW3 (ON signal) to the switch elements 56 during one horizontal scanning (1 H) period.

The signal line driver circuit 90 is formed of ICs (integrated circuit), and is mounted on the glass substrate 4*a* (COG mounting). The signal line driver circuit 90 is indirectly connected to the plurality of signal lines 16 as explained-above. The signal line driver circuit 90 is connected also to the plurality of pads. The signal line driver circuit 90 transmits the image signal supplied through the plurality of pads to the switch circuit 13.

Figure 8:
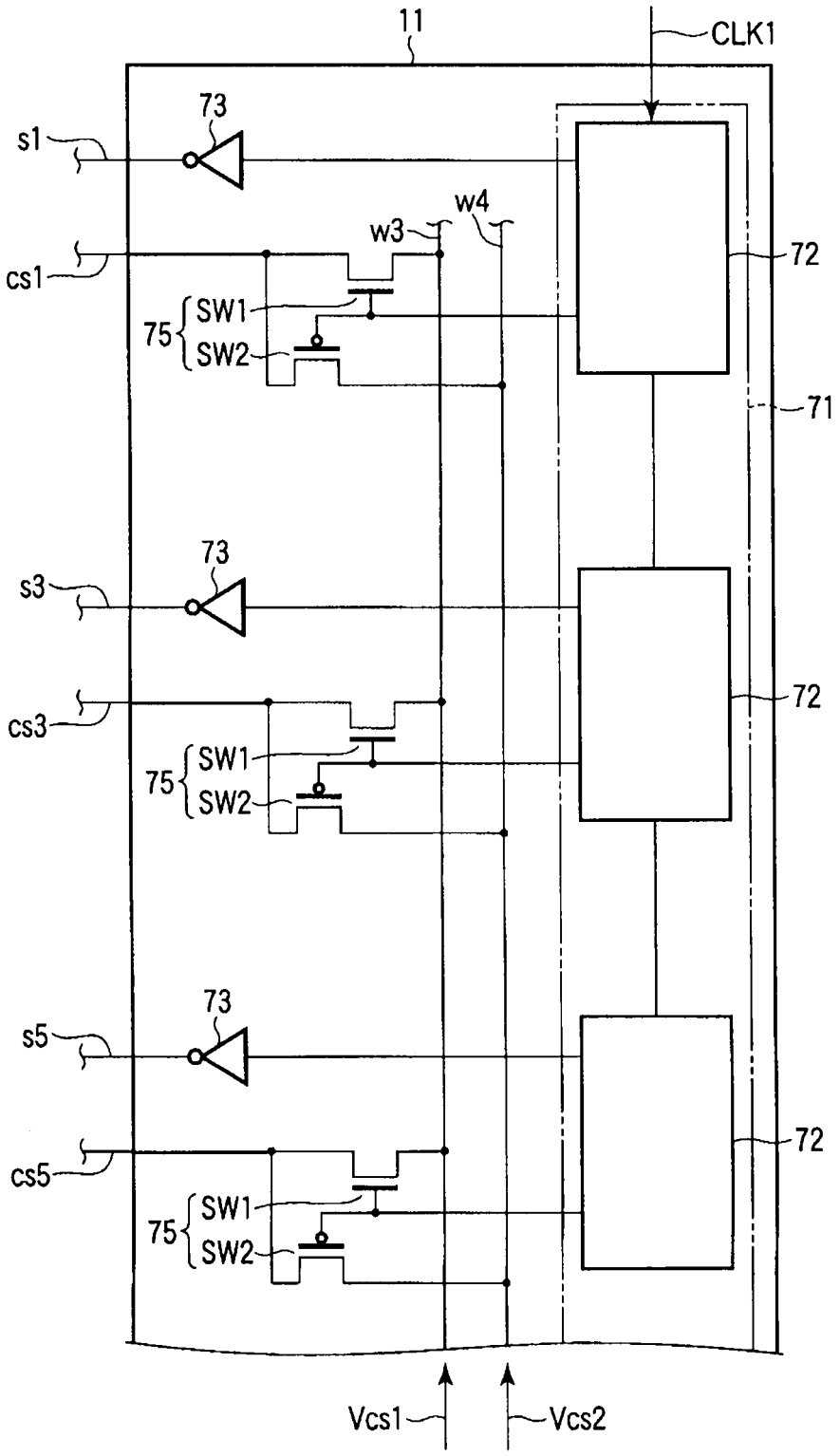
FIG. 8 is a block diagram showing a first driver circuit formed on the array substrate.

As shown in FIG. 3, the first driver circuit 11 and the second driver circuit 12 are arranged interposing the plurality of pixel electrodes 21 therebetween in the second direction X. As shown in FIG. 3 and FIG. 8, the first driver circuit 11 includes a sequential circuit 71 as a first sequential circuit, a plurality of auxiliary capacitance power supply selection circuits 75, and a plurality of buffers 73. The sequential circuit 71 includes a plurality of shift registers 72 of the same number as odd scanning lines "s" (s1, s3, -sn−1). The buffers 73 are connected to the corresponding shift register 72. The buffers 73 are connected to a plurality of odd scanning lines "s". Accordingly, the first driver circuit 11 can supply scanning signals G (G1, G3, -Gn−1) in order to the plurality of odd scanning lines "s" through the buffer 73.

A first auxiliary capacitance voltage supply line w3 and a second auxiliary capacitance voltage supply line w4 extend in the inside of the first driver circuit 11, and form the first driver circuit 11. The first auxiliary capacitance voltage supply line w3 and the second auxiliary capacitance voltage supply line w4 extend to outside of the first driver circuit 11, and are connected to the pads p3 and p4, respectively. A first auxiliary capacitance voltage Vcs1 is supplied to the first auxiliary capacitance voltage supply line w3 through the pad p3. A second auxiliary capacitance voltage Vcs2 is supplied to the second auxiliary capacitance voltage supply line w4 through the pad p4. The second auxiliary capacitance voltage Vcs2 differs from the first auxiliary capacitance voltage Vcs1 in potential.

An auxiliary capacitance power supply selection circuit 75 is formed corresponding to an odd auxiliary capacitance line (cs1, cs3, -csn−1). The auxiliary capacitance power supply selection circuit 75 includes an NMOS transistors SW1 as a switching element which selects whether the auxiliary capacitance power supply selection circuit 75 supplies the first auxiliary capacitance voltage Vcs1, and a PMOS transistor SW2 as a switching element which selects whether the second auxiliary capacitance voltage Vcs2 (>Vcs1) is supplied to the odd auxiliary capacitance lines "cs". The ON/OFF of the NMOS transistor SW1 and the PMOS transistor SW2 is switched based on a polarity-reversal control signal from the shift register 72.

The auxiliary capacitance power supply selection circuits 75 are connected to the plurality of odd auxiliary capacitance lines "cs", respectively. The first driver circuit 11 supplies the first auxiliary capacitance voltage Vcs1 and the second auxiliary capacitance voltage Vcs2 by turns for every fixed cycle to the plurality of odd auxiliary capacitance lines "cs". In this embodiment, the above-mentioned fixed cycle is one frame period.

Figure 9:
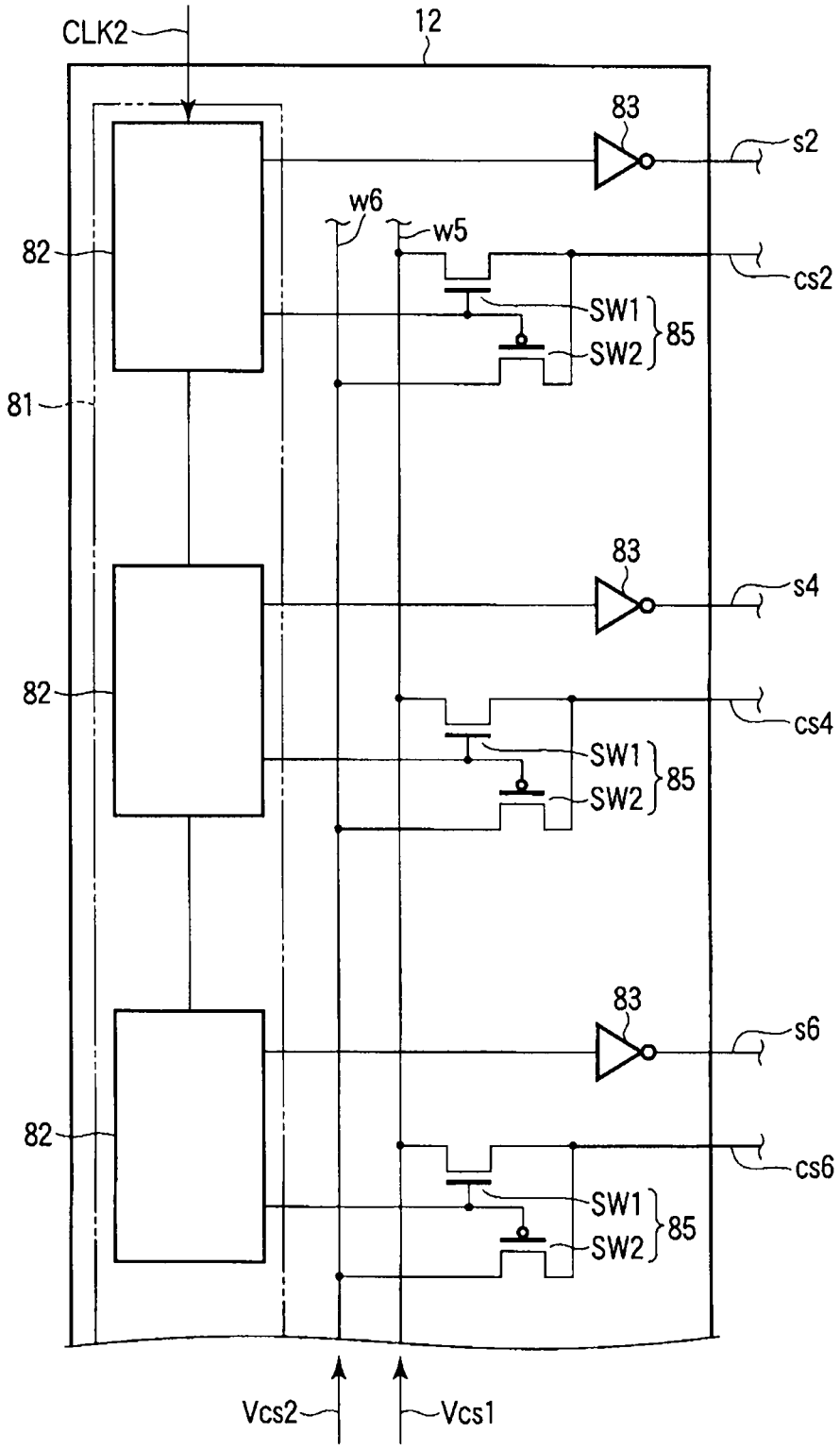
FIG. 9 is a block diagram showing a second driver circuit formed on the array substrate.
Figure 10:
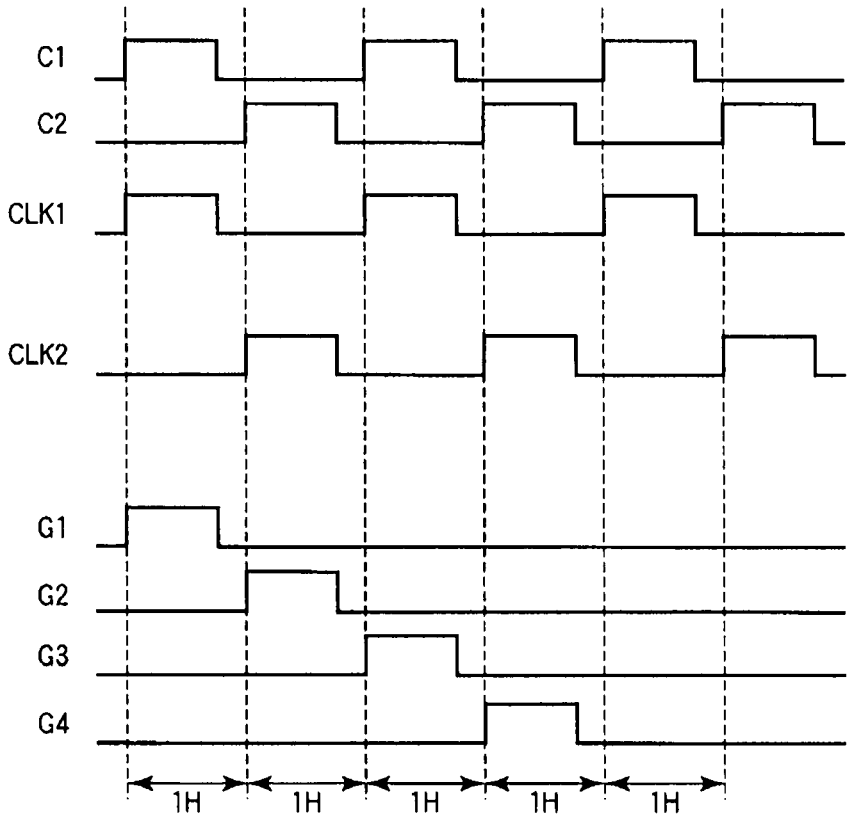
FIG. 10 is a timing chart according to the first embodiment showing a first control signal C1, a second control signal C2, a first synchronization signal CLK1, a second synchronization signal CLK2, and scanning signals G1 to G4.

As shown in FIG. 3 and FIG. 9, the second driver circuit 12 includes a sequential circuit 81 as a second sequential circuit, a plurality of auxiliary capacitance power supply selection circuits 85, and a plurality of buffers 83. The sequential circuit 81 includes a plurality of shift registers 82 of the same number as the plurality of even scanning lines "s" (s2, s4, - - - sn). The buffer 83 is connected to the corresponding shift register 82. The buffers 83 are connected to the plurality of even scanning lines "s". Accordingly, the second driver circuit 12 can supply the scanning signals G (G2, G4, -Gn) in order to the plurality of even scanning lines "s" through the buffer 83.

A first auxiliary capacitance voltage supply line w5 and a second auxiliary capacitance voltage supply line w6 extend in the inside of the second driver circuit 12 constituting the second driver circuit 12. The first and second auxiliary capacitance voltage supply lines w5 and w6 extend to the outside of the second driver circuit 12, and are connected to the pads p5 and p6, respectively. The first auxiliary capacitance voltage Vcs1 is supplied to the first auxiliary capacitance voltage supply line w5 through the pad p5. The second auxiliary capacitance voltage Vcs2 is supplied to the second auxiliary capacitance voltage supply line w6 through the pad p6.

Auxiliary capacitance power supply selection circuits 85 are formed corresponding to the plurality of even auxiliary capacitance lines "cs" (cs2, cs4, - - - csn). An NMOS transistor SW1 as a switching element which selects whether the auxiliary capacitance power supply selection circuit 85 supplies the first auxiliary capacitance voltage Vcs1, and a PMOS transistor SW2 as a switching element which selects whether the second auxiliary capacitance voltage Vcs2 (>Vcs1) is supplied to the even auxiliary capacitance lines "cs". The ON/OFF of the NMOS transistor SW1 and the PMOS transistor SW2 is switched based on a polarity-reversal control signal from the shift register 82.

The auxiliary capacitance power supply selection circuit 85 is connected to the plurality of even auxiliary capacitance lines "cs", respectively. The second driver circuit 12 supplies the first auxiliary capacitance voltage Vcs1 and the second auxiliary capacitance voltage Vcs2 to the plurality of even auxiliary capacitance lines "cs" in order by turns for every fixed cycle.

As shown in FIG. 3, FIG. 8, and FIG. 9, the timing control circuit 70 is connected to the pads p1 and p2 through the wirings w1 and w2. A first control signal C1 is supplied to the timing control circuit 70 through the pad p1 and the wiring w1 from the control portion 100. Moreover, a second control signal C2 is supplied to the timing control circuit 70 through the pad p2 and the wiring w2 from the control portion 100.

The timing control circuit 70 and the buffer 80 are connected by a wiring w7. The buffer 80 and the first driver circuit 11 are connected by a wiring w8. The buffer 80 and the second driver circuit 12 are connected by a wiring w9.

The timing control circuit 70 is formed by combining a divider circuit and a shift register having two stages. The timing control circuit 70 generates a first synchronization signal CLK1 and a second synchronization signal CLK2 in which the respective phases differ each other, by supplying the first control signal C1 and the second control signal C2. The timing control circuit 70 supplies the first synchronization signal CLK1 to the first driver circuit 11 through the buffer 80, and similarly supplies the second synchronization signal CLK2 to the second driver circuit 12 through the buffer 80.

Accordingly, when the first synchronization signal CLK1 and the second synchronization signal CLK2 are supplied from the timing control circuit 70 to the first driver circuit 11 and the second driver circuit 12, the first driver circuit 11 and the second driver circuit 12 can supply the scanning signals G in order to the plurality of scanning lines "s" for every line. Moreover, in this case, the first driver circuit 11 and the second driver circuit 12 can supply the first auxiliary capacitance voltage Vcs1 and the second auxiliary capacitance voltage Vcs2 to the plurality of auxiliary capacitance lines "cs" by turns for every fixed cycle.

Next, an operation of the first driver circuit 11 and the second driver circuit 12 is explained in detail when the first synchronization signal CLK1 and the second synchronization signal CLK2 are supplied to the first driver circuit 11 and the second driver circuit 12 from the timing control circuit 70.

When the first control signal C1 and the second control signal C2 are supplied to the timing control circuit 70 as shown in FIG. 3, FIG. 8, FIG. 9, and FIG. 10, the timing control circuit 70 supplies the generated first synchronization signal CLK1 and second synchronization signal CLK2 to the first driver circuit 11 and the second driver circuit 12, respectively. The second synchronization signal CLK2 is shifted from the first synchronization signal CLK1 by one horizontal scanning period (1 H).

In the first one-frame period, during the first horizontal scanning period, the first driver circuit 11 supplies a first scanning signal G1 to the scanning line "s1", and thereby, a pixel signal is written into the pixel electrode 21 of the pixel 18 of the first line by switching the TFT 22 of the pixel 18 to ON state. Furthermore, the first auxiliary capacitance voltage Vcs1 held in the first auxiliary capacitance line Cs1 is switched to the second auxiliary capacitance voltage Vcs2 after the pixel signal is written into the pixel 18.

Subsequently, during a next horizontal scanning period, the second driver circuit 12 supplies a scanning signal G2 to the scanning line s2, thereby, a pixel signal is written into the pixel electrode 21 of the pixel 18 in the second line by switching the TFT 22 to ON state. Further, the potential of the second auxiliary capacitance line Cs2 holding the capacitance voltage Vcs1 is switched to the second auxiliary capacitance voltage Vcs2 after the pixel signal is written into the pixel 18.

After that, similarly, the scanning signals G3 to Gn are respectively supplied in order to the scanning lines "s3" to "sn" for every 1 horizontal scanning period, and first auxiliary capacitance voltage Vcs1 is supplied in order to the auxiliary capacitance lines cs3 to "can". In addition, in the above one-frame period, the shift registers 72 and 82 switch the NMOS transistor SW1 to the ON state, and the PMOS transistor SW2 to the OFF state.

In the next one-frame period, during the first horizontal scanning period, the first driver circuit 11 supplies a first scanning signal G1 to the scanning line "s1", and thereby, a pixel signal is written into the pixel electrode 21 of the pixel 18 of the first line by switching the TFT 22 of the pixel 18 to ON state. Furthermore, the potential of the first auxiliary capacitance line Cs1 holding the second auxiliary capacitance voltage Vcs2 is switched to the first auxiliary capacitance voltage Vcs1 after the pixel signal is written into the pixel 18.

Subsequently, during a next horizontal scanning period, the second driver circuit 12 supplies a scanning signal G2 to the scanning line "s2", thereby, a pixel signal is written into the pixel electrode 21 of the pixel 18 in the second line by switching the TFT 22 to ON state. Further, the potential of the second auxiliary capacitance line Cs2 holding the capacitance voltage Vcs2 is switched to the first auxiliary capacitance voltage Vcs1 after the pixel signal is written into the pixel 18.

After that, similarly, the scanning signals G3 to Gn are respectively supplied in order to the scanning lines "s3" to "sn" for every 1 horizontal scanning period, and the second auxiliary capacitance voltage Vcs2 is supplied in order to the auxiliary capacitance lines cs3 to "csn". In addition, in the above-mentioned one-frame period, the shift registers 72 and 82 switch the NMOS transistor SW1 to the OFF state, and the PMOS transistor SW2 to the ON state. As mentioned-above, a capacitance coupling drive is performed by switching the voltage supplied to the auxiliary capacitance line "cs" for every one frame period.

Figure 11:
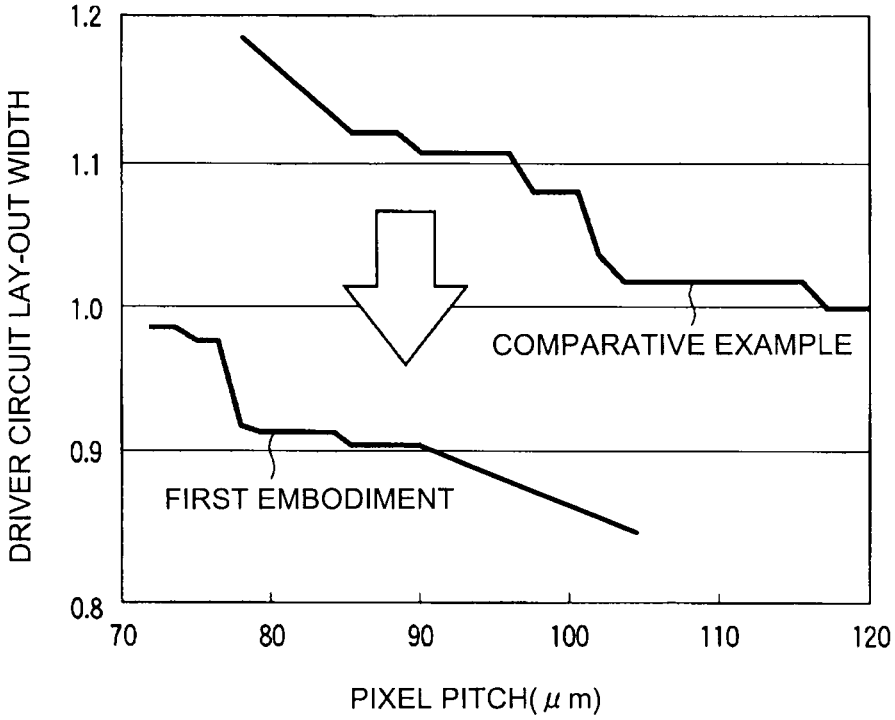
FIG. 11 is a graph showing a change of the width of the driver circuit lay-out with respect to the pixel pitch in the liquid crystal display devices according to the first embodiment and a comparative example.

Here, the inventor investigated the lay-out width of the driver circuit with reference to the pixel pitch. FIG. 11 is a graph showing a change of the lay-out width in the second direction X of the driver circuit with reference to the pixel pitch. In addition, the investigation is carried out to compare between the liquid crystal display devices of this embodiment and the comparative example.

The driver circuit of the liquid crystal display device according to the comparative example is arranged at only either one of the right and left sides of the display region, while being divided in this embodiment. In addition, the liquid crystal display device of the comparative example is formed like the liquid crystal display device according to this embodiment in other points than the above. The lay-out width was evaluated by making the lay-out width in the liquid crystal display device of the comparative example as a reference value 1.0 in case the pixel pitch in the first direction Y is 120 μm.

According to the result of the evaluation, in the comparative example, the lay-out width of the driver circuit with reference to the pixel pitch relatively spread more in a range in which the pixel pitch becomes 90 μm or less, and it turns out that a narrow frame cannot be attained if the pixel pitch is designed narrower than the value (90 μm). On the other hand, in the liquid crystal display device according to this embodiment, even if the pixel pitch is 90 μm or less, the relative value of the lay-out width of the driver circuit is 1.0, and it turns out that the narrow frame can be obtained.

According to the liquid crystal display device constituted as mentioned-above, the liquid crystal display device includes the array substrate 1, the counter substrate 2, and the liquid crystal layer 3. The array substrate 1 includes the plurality of signal lines 16, scanning lines "s", TFTs 22, pixel electrodes 21, the first driver circuit 11, the second driver circuit 12, and the timing control circuit 70 which are formed on the glass substrate 4*a*, respectively. The first driver circuit 11 connected to the plurality of odd scanning lines "s" includes the sequential circuit 71, and supplies the scanning signals G in order to the odd scanning lines "s". The second driver circuit 12 connected to the even scanning lines "s" includes the sequential circuit 81, and supplies the scanning signals G in order to the even scanning lines "s".

The timing control circuit 70 generates the first synchronization signal CLK1 and the second synchronization signal CLK2 whose phase differs from that of the first synchronization signal CLK1. The generated first synchronization signal CLK1 is supplied to the first driver circuit 11, and the generated second synchronization signal CLK2 is supplied to the second driver circuit 12. The first driver circuit 11 and the second driver circuit 12 supply the scanning signals G in order to the respective scanning lines "s" upon receiving the first synchronization signal CLK1 and the second synchronization signal CLK2 from the timing control circuit 70.

When arranging the driver circuit only at the left-hand side or the right-hand side of the display region, it is necessary to arrange a peripheral circuit in a region corresponding to one pixel pitch. However, it becomes possible to arrange the peripheral circuit in the region corresponding two pixel pitches by dividing the driver circuit into two driver circuits, i.e., the first driver circuit 11 and the second driver circuit 12. Thereby, the narrow frame can be obtained. Moreover, the circuit width can be reduced by 20% to 25% by dividing the driver circuit into two driver circuits.

The first driver circuit 11 and the second driver circuit 12 are constituted so that the first driver circuit 11 and the second driver circuit 12 supply the scanning signals G to the respective scanning line "s" by turns. The first driver circuit 11 includes the shift registers 72 of the same number as the odd scanning lines "s". Similarly, the second driver circuit 12 includes the shift registers 82 of the same number as the even scanning lines "s". Since the increase in number of the shift registers is suppressed in the first driver circuit 11 and the second driver circuit 12, the narrow frame can be obtained.

The first synchronization signal CLK1 and the second synchronization signal CLK2 supplied to the first driver circuit 11 and the second driver circuit 12 can be generated in the timing control circuit 70 by forming the timing control circuit 70 on the glass substrate 4*a*. Since the signal line driver circuit 90 and the control portion 100 need neither generate the first synchronization signal CLK1 nor the second synchronization signal CLK2, a newly developed IC may not be needed. Instead, currently available ICs can be used. Thereby, the rising in the product price can be suppressed.

When controlling the auxiliary capacitance lines "cs" by a capacitive coupling drive, etc. for every line, a cross talk may be generated in the auxiliary capacitance lines with increase in the area of the liquid crystal display panel 1. In this case, a cross talk rate is low at the power supply side of auxiliary capacitance lines, and tends to become larger with departing from the power supply side. However, in this embodiment, the first driver circuit 11 is connected to the plurality of odd auxiliary capacitance lines "cs", and the second driver circuit 12 is connected to the plurality of even auxiliary capacitance lines "cs". In the above-mentioned liquid crystal display device, the cross talk rate in the right side and the left side of the screen is equalized by changing the supply direction of the auxiliary capacitance voltage to the auxiliary capacitance lines "cs" for every line, and thereby, an advantage that the cross talk is hardly sighted is also obtained.

As mentioned-above, the narrow frame can be attained, and the liquid crystal display device in which the increase in the product price can be suppressed is obtained.

Next, the liquid crystal display device according the second embodiment is explained in detail. The same mark or symbol is denoted in the same portion, and the detailed explanation is omitted about the same portion.

Figure 12:
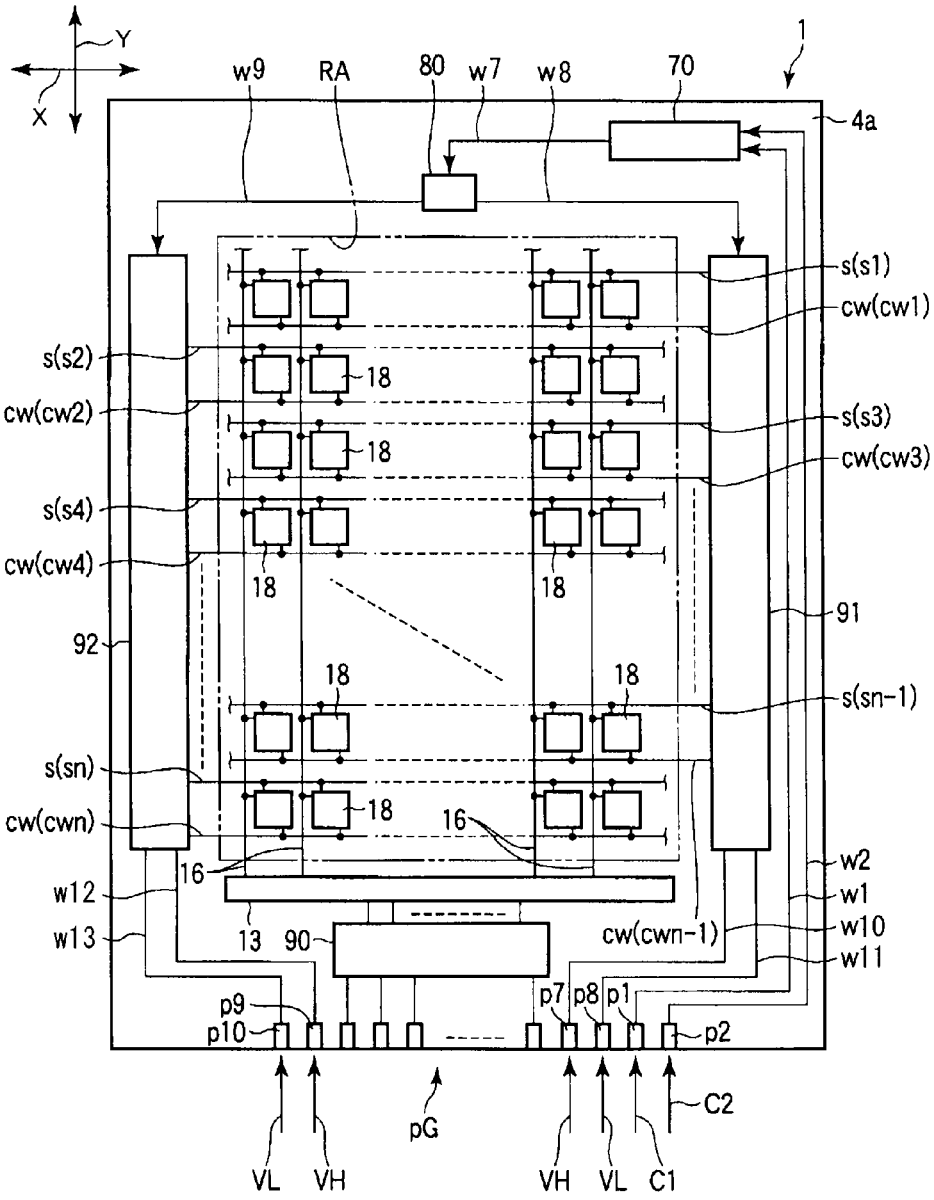
FIG. 12 is a plan view showing a schematic structure of the array substrate in the liquid crystal display device according to a second embodiment.
Figure 13:
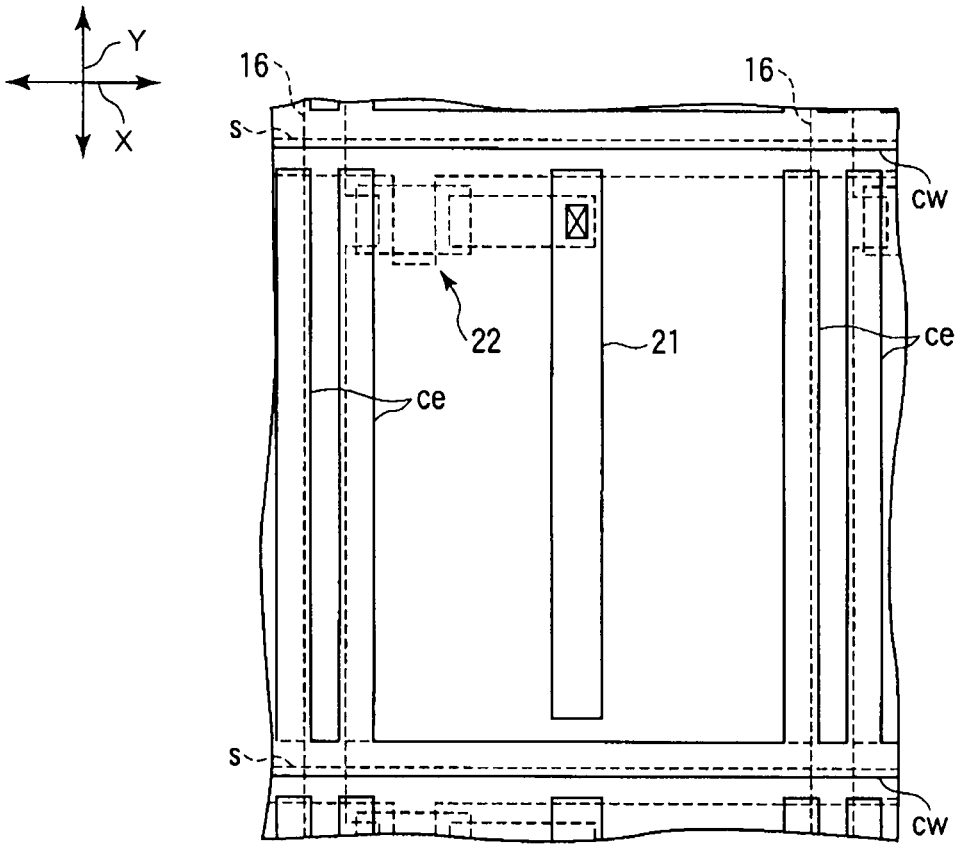
FIG. 13 is an enlarged plan view showing a portion of the array substrate shown in FIG. 12, and is a figure showing a wiring structure of the pixel, especially.

In this embodiment, the display mode of the liquid crystal display device is an IPS mode as shown in FIG. 12 and FIG. 13. The first driver circuit 11 and the second driver circuit 12 double as the scanning line driver circuit and the common electrode driver circuit. In the display region RA, a plurality of common wirings cw (cw1, cw2, -cwn) and common electrodes "ce" are formed on the glass substrate 4*a*. The common electrode "ce" is formed extending from the common wiring "cw".

The common wiring "cw" and the common electrode "ce" are formed simultaneously on the colored layer 51 using the same material as the pixel electrode 21. The pixel electrode 21 and the common electrode "ce" are arranged with an interval therebetween so that electric field is generated in the second direction X. The pixel electrode 21 is formed in every one pixel 18 in the shape of a stripe, and extends in the first direction Y.

A common wiring "cw" is formed extending along the short side of the pixel electrode 18 in the second direction X. Two common electrodes "ce" are formed in every pixel 18. The common electrodes "ce" arranged in the pixel 18 are formed extending from one common wiring "cw" in the first direction Y. The two common electrodes "ce" are arranged along both long sides of the pixel 18 in the first direction Y interposing the pixel electrode 21 therebetween.

In the state where a voltage is impressed between the pixel electrode 21 and the common electrode "ce", the pixel electrode 21 and the common electrode "ce" generate a lateral electric field in the second direction X. On the contrast, in the state where the voltage is not impressed between the pixel electrode 21 and the common electrode "ce", the pixel electrode 21 and the common electrode "ce" do not generate the lateral electric field in the second direction X. In addition, the liquid crystal display device does not have the counter electrode 61 in this embodiment. Moreover, an auxiliary capacitance is formed between the pixel electrode 21 and the common electrode "ce" as an auxiliary capacitance element in this embodiment.

The first driver circuit 91 and the second driver circuit 92 are arranged on both long sides of a matrix of the plurality of pixel electrodes 21. The first driver circuit 91 includes a sequential circuit and a plurality of buffers. The sequential circuit includes a plurality of shift registers of the same number as the odd scanning lines "s" (s1, s3, -sn−1).

A first power supply wiring w10 and a second power supply wiring w11 extend from the first driver circuit 91, and are connected to the pads p7 and p8 arranged at one side of the array substrate 1. A high-level voltage VH is supplied to the first power supply wiring w10 through the pad p7. A low level voltage VL is supplied to the second power supply wiring w11 through the pad p8. The voltage VH differs from the voltage VL in potential.

The first driver circuit 91 is connected to the plurality of odd scanning lines "s" (s1, s3, - - - sn−1), and the plurality of odd common wirings cw (cw1, cw3, -cwn−1). The first driver circuit 91 supplies the scanning signals G in order to the odd scanning lines "s", and supplies common voltage to the plurality of odd common wirings "cw".

The second driver circuit 92 includes a sequential circuit and a plurality of buffers. The sequential circuit includes a plurality of shift registers of the same number as the even scanning lines "s" (s2, s4, -sn).

A first power supply wiring w12 and a second power supply wiring w13 extend from the second driver circuit 92, and are connected to the pads p9 and p10 arranged at one side of the array substrate 1. The high-level voltage V11 is supplied to the first power supply wiring w12 through the pad p9. The low-level voltage VL is supplied to the second power supply wiring w13 through the pad p10.

The second driver circuit 92 is connected to the plurality of even scanning lines "s" (s2, s4, -sn) and the plurality of even common wirings "cw" (cw2, cw4, -cwn). The second driver circuit 92 supplies the scanning signals G in order to the even scanning lines "s", and supplies common voltages to the even common wirings "cw".

A first common voltage and a second common voltage of different potential from that of the first common voltage are supplied by turns to the even common wiring and odd common wiring for every fixed cycle, for example, for one frame period.

The timing control circuit 70 supplies the first synchronization signal CLK1 to the first driver circuit 91 through the buffer 80, and supplies the second synchronization signal CLK2 to the second driver circuit 92 through the buffer 80. Accordingly, the first driver circuit 91 and the second driver circuit 92 can supply the scanning signals G in order to the scanning lines "s" for every line when the first synchronization signal CLK1 and the second synchronization signal CLK2 are supplied from the timing control circuit 70. Moreover, in this case, the first driver circuit 91 and the second driver circuit 92 can supply the first common voltage and the second common voltage by turns to the common wirings "cw" for every line.

According to the liquid crystal display device constituted as mentioned-above, the liquid crystal display device includes the array substrate 1, the counter substrate 2, and the liquid crystal layer 3. The array substrate 1 includes the plurality of signal lines 16, scanning lines "s", TFTs 22, pixel electrodes 21, the first driver circuit 11, the second driver circuit 12, and the timing control circuit 70 which are formed on the glass substrate 4*a*, respectively. The first driver circuit 91 connected to the plurality of odd scanning lines "s" includes a sequential circuit, and supplies the scanning signals G in order to the odd scanning lines "s". The second driver circuit 92 connected to the even scanning lines "s", includes a sequential circuit, and supplies the scanning signals G in order to the even scanning lines "s".

The timing control circuit 70 generates the first synchronization signal CLK1 and the second synchronization signal CLK2 whose phase differs from that of the first synchronization signal CLK1. The generated first synchronization signal CLK1 is supplied to the first driver circuit 91, and the generated second synchronization signal CLK2 is supplied to the second driver circuit 92. The first driver circuit 91 and the second driver circuit 92 supply the scanning signals G in order to the respective scanning lines "s" upon receiving the first synchronization signal CLK1 and the second synchronization signal CLK2 from the timing control circuit 70.

As mentioned-above, the liquid crystal display device according to this embodiment can achieve the same effect as the liquid crystal display device according the first embodiment. Therefore, the narrow frame can be attained, and the liquid crystal display device which can suppress the increase in a product price can be obtained.

For example, the first driver circuit and the second driver circuit of the embodiments may be constituted so that the scanning signals are supplied at least to the scanning lines "s" in order for every line. In addition, the mode of the liquid crystal display device of the embodiment is not limited to the mode as mentioned-above, and various modes can be used. For example, the liquid crystal display device of the IPS mode in the second embodiment can be changed to the liquid crystal display device using an FFS mode.

While certain embodiments have been described, these embodiments have been presented by way of embodiment only, and are not intended to limit the scope of the inventions. In practice, the structural elements can be modified without departing from the spirit of the invention. Various embodiments can be made by properly combining the structural elements disclosed in the embodiments. For embodiment, some structural elements may be omitted from all the structural elements disclosed in the embodiments. Furthermore, the structural elements in different embodiments may properly be combined. The accompanying claims and their equivalents are intended to cover such forms or modifications as would fall with the scope and spirit of the inventions.

What is claimed is:

1. A liquid crystal display device having a plurality of pixels arranged in a matrix of a first direction and a second direction crossing with the first direction, comprising:

an array substrate including:

a plurality of signal lines extending in the first direction, a plurality of scanning lines having odd scanning lines and even scanning lines extending in the second direction, a switch element provided in each pixel and electrically connected with the signal line and the scanning line, a pixel electrode electrically connected with each switching element, a first driver circuit and a second driver circuit arranged interposing the matrix of pixels in the second direction, and a timing control circuit electrically connected with the first and second driver circuits, a plurality of auxiliary capacitance lines having odd auxiliary capacitance lines electrically connected with respective pixels arranged in odd lines in the second direction and even auxiliary capacitance lines electrically connected with respective pixels arranged in even lines extending in the second direction, and a plurality of auxiliary capacitance electrodes arranged opposing the auxiliary capacitance lines interposing an insulating layer therebetween and electrically connected with the pixel electrode for forming a plurality of auxiliary capacitance elements therebetween, a counter substrate arranged opposing the array substrate with a gap therebetween; and a liquid crystal layer held between the array substrate and the counter substrate; wherein the first driver circuit including a first sequential circuit is electrically connected with the odd scanning lines and the odd auxiliary capacitance lines, and supplies scanning signals to the odd scanning lines in order, and further, the first driver circuit supplies first and second auxiliary capacitance voltages different from each other to the odd auxiliary capacitance lines, respectively, by turns for every cycle period after image signals have been written into the pixel electrode, the second driver circuit including a second sequential circuit is electrically connected with the even scanning lines and the even auxiliary capacitance lines, and supplies the scanning signals to the even scanning lines in order, and further, the second driver circuit supplies the first and second auxiliary capacitance voltages different from each other to the even auxiliary capacitance lines, respectively, by turns for every cycle period after image signals have been written into the pixel electrode, the timing control circuit is supplied with a first control signal and a second control signal from an outside control portion, and generates a first synchronization signal and a second synchronization signal, and supplies the first synchronization signal to the first driver circuit and the second synchronization signal to the second driver circuit, the first and second driver circuits supply the scanning signals to the scanning lines in order for every line, and also supply a first auxiliary capacitance voltage and a second auxiliary capacitance voltage to the auxiliary capacitance lines upon receiving the first synchronization signal and the second synchronization signal from the timing control circuit, the first driver circuit includes a plurality of shift registers of a number the same as a number of odd scanning lines, and the second driver circuit includes a plurality of shift registers of a number the same as a number of the even scanning lines, and the first and second driver circuits respectively include an auxiliary capacitance power selection circuit connected with each shift register and driven by the timing control circuit.

2. The liquid crystal display device according to claim 1, further comprising a signal line driving circuit formed of an integrated circuit, wherein the signal driving circuit is mounted on the array substrate and electrically connected with the plurality of signal lines.

3. The liquid crystal display device according to claim 2, further comprising a switch circuit connected with the signal line driving circuit, wherein the switch circuit is formed of a multiplexer circuit.

4. The liquid crystal display device according to claim 1, wherein the switching elements, the first driver circuit, the second driver circuit and the timing control circuit are formed of poly-silicon on the array substrate.

5. The liquid crystal display device according to claim 1, wherein the first and second driver circuits respectively include a plurality of buffers connected with the scanning lines.

6. The liquid crystal display device according to claim 1, wherein the counter substrate includes a counter electrode for generating a vertical electric field between the counter electrode and the pixel electrode.

7. The liquid crystal display device according to claim 1, wherein a pulse phase of the first synchronization signal is shifted from the second synchronization signal by a predetermined period.

8. The liquid crystal display device according to claim 1, wherein the first and second driver circuits supply the first and second auxiliary capacitance voltages to the auxiliary capacitance lines by turns for every one frame period.

9. The liquid crystal display device according to claim 1, a pixel pitch of the pixel is 90 μm or less.

10. A liquid crystal display device having a plurality of pixels arranged in a matrix of a first direction and a second direction crossing with the first direction, comprising:

an array substrate including:

a plurality of signal lines extending in the first direction, a plurality of scanning lines having odd scanning lines and even scanning lines extending in the second direction, a switch element provided in each pixel and electrically connected with the signal lines and the scanning lines, a pixel electrode electrically connected with each switching element, a first driver circuit and a second driver circuit arranged interposing the matrix of pixels in the second direction, a timing control circuit electrically connected with the first and second driver circuits, and a plurality of auxiliary capacitance lines formed on the array substrate and extending in the second direction, and a plurality of auxiliary capacitance electrodes arranged opposing the auxiliary capacitance lines interposing an insulating layer therebetween and electrically connected with the pixel electrode for forming a plurality of auxiliary capacitance elements therebetween, a counter substrate arranged opposing the array substrate with a gap therebetween; and a liquid crystal layer held between the array substrate and the counter substrate; wherein the first driver circuit includes a first sequential circuit electrically connected with the odd scanning lines, and supplies scanning signals to the odd scanning lines in order, the second driver circuit includes a second sequential circuit electrically connected with the even scanning lines, and supplies the scanning signals to the even scanning lines in order, the timing control circuit is supplied with a first control signal and a second control signal from an outside control portion, and generates a first synchronization signal and a second synchronization signal, and supplies the first synchronization signal to the first driver circuit and the second synchronization signal to the second driver circuit, and the first and second driver circuits supply the scanning signals to the scanning lines in order for every line upon receiving the first synchronization signal and the second synchronization signal from the timing control circuit, the first driver circuit is connected with a plurality of odd auxiliary capacitance lines and supplies a first auxiliary capacitance voltage and a second auxiliary capacitance voltage different from the first voltage to the odd auxiliary capacitance lines by turns for every cycle period, the second driver circuit is connected with a plurality of even auxiliary capacitance lines and supplies a first auxiliary capacitance voltage and a second auxiliary capacitance voltage to the even auxiliary capacitance lines by turns for every cycle period, and the first and second driver circuits supply a first auxiliary capacitance voltage and a second auxiliary capacitance voltage to the auxiliary capacitance lines upon receiving the first synchronization signal and the second synchronization signal from the timing control circuit by turns for every line.

11. The liquid crystal display device according to claim 10, wherein the first and second driver circuits respectively include a plurality of buffers connected with the scanning lines.

12. The liquid crystal display device according to claim 10, wherein a pulse phase of the first synchronization signal is shifted from the second synchronization signal by a predetermined period.

13. The liquid crystal display device according to claim 10, wherein the first driver circuit includes a plurality of shift registers of the same number of the odd scanning lines, and the second driver circuit includes a plurality of shift registers of the same number of the even scanning lines.

14. The liquid crystal display device according to claim 13, wherein the first and second driver circuits respectively include an auxiliary capacitance power selection circuit connected with each shift register.

15. The liquid crystal display device according to claim 10, wherein the first and second driver circuits supply the first and second auxiliary capacitance voltages to the auxiliary capacitance lines by turns for every one frame period.

16. A liquid crystal display device having a plurality of pixels arranged in a matrix of a first direction and a second direction crossing with the first direction, comprising:

an array substrate including:

a plurality of signal lines extending in the first direction, a plurality of scanning lines having odd scanning lines and even scanning lines extending in the second direction, a switch element provided in each pixel and electrically connected with the signal lines and the scanning lines, a pixel electrode electrically connected with each switching element, a first driver circuit connected to the odd scanning lines and including a first shift register circuit having respective first shift registers serially connected and supplying scanning signals to the odd scanning lines in order, a second driver circuit connected to the even scanning lines and including a second shift register circuit having respective second shift registers serially connected and supplies the scanning signals to the even scanning lines in order, a timing control circuit electrically connected with the first and second driver circuits and supplying respective first and second synchronization signals to the first and second driver circuits, an auxiliary capacitance power selection circuit connected with each shift register, a counter substrate arranged opposing the array substrate with a gap therebetween; and a liquid crystal layer held between the array substrate and the counter substrate, wherein each of the first and second shift registers supplies a control signal to one of the auxiliary capacitance power circuits and supplies scanning signals to one of the odd and even scanning lines, each of the first shift registers receives the first synchronization signal and outputs the first synchronization signal to a subsequently-connected one of the first shift registers, and each of the second shift registers receives the second synchronization signal and outputs the second synchronization signal to a subsequently-connected one of the second shift registers.

* * * * *